US011505395B2

(12) United States Patent
Hazen

(10) Patent No.: US 11,505,395 B2
(45) Date of Patent: Nov. 22, 2022

(54) SOFT-SIDED BEVERAGE INSULATING DEVICE AND SYSTEM

(71) Applicant: Puffin Coolers, LLC, Bend, OR (US)

(72) Inventor: Tyrone Hazen, Bend, OR (US)

(73) Assignee: Puffin Coolers, LLC, Bend, OR (US)

( * ) Notice: Subject to any disclaimer, the term of this patent is extended or adjusted under 35 U.S.C. 154(b) by 0 days.

(21) Appl. No.: 17/069,295

(22) Filed: Oct. 13, 2020

(65) Prior Publication Data

US 2021/0032006 A1 Feb. 4, 2021

Related U.S. Application Data

(63) Continuation of application No. 16/254,302, filed on Jan. 22, 2019, now abandoned.

(60) Provisional application No. 62/620,973, filed on Jan. 23, 2018.

(51) Int. Cl.
*B65D 81/38* (2006.01)
*A47G 23/02* (2006.01)

(52) U.S. Cl.
CPC ..... *B65D 81/3886* (2013.01); *A47G 23/02* (2013.01); *A47G 2023/0291* (2013.01)

(58) Field of Classification Search
CPC ..... A47G 2023/0275; A47G 2023/083; A47G 2023/0291; B65D 81/3876; B65D 81/3879; B65D 81/3881; B65D 81/3883; B65D 81/3888; B65D 81/3897
See application file for complete search history.

(56) References Cited

U.S. PATENT DOCUMENTS 1,895,278 A * 1/1933 Crawford ..... B65D 81/3897 383/110
1,922,485 A * 8/1933 McKee ..... B65D 81/3886 383/110
4,197,890 A * 4/1980 Simko ..... F25D 31/007 383/97
4,401,245 A * 8/1983 Zills ..... B65D 81/3897 224/148.6
4,871,597 A * 10/1989 Hobson ..... B32B 27/12 428/36.1
5,005,374 A * 4/1991 Spitler ..... A41D 13/0055 2/171.2
5,313,807 A * 5/1994 Owen ..... B65D 81/3886 62/530
5,680,958 A * 10/1997 Mann ..... B65D 25/2873 220/739

(Continued)

*Primary Examiner* — Joshua E Rodden
(74) *Attorney, Agent, or Firm* — Leber IP Law; Celia Leber

(57) ABSTRACT

The present invention is a novel soft-sided beverage insulating device and system intended to be an improvement over prior art. The invention is designed to envelope, wrap, hold or otherwise secure a container with liquid content. The invention improves upon the prior art by improving upon liquid content temperature control, an over-cap or cap for protection of or to reseal a liquid content container, a frame to support a geometric shape and provide a compartment for novelty electronics such as LED lights or other low voltage electronics. The invention offers a leverage opening system to access the liquid content of the enveloped container and an attachment point for straps, harness or other attachment to increase transportability of the said device. Additionally, embodiments allow for bespoke modifications for cosmetic purposes, fit and novelty.

8 Claims, 10 Drawing Sheets

(56) References Cited

U.S. PATENT DOCUMENTS

| | | | | | |
|---|---|---|---|---|---|
| 5,915,580 | A * | 6/1999 | Melk | B65D 81/3886 | 220/592.24 |
| 6,073,796 | A * | 6/2000 | Mogil | A45F 3/16 | 215/12.1 |
| 6,401,993 | B1 * | 6/2002 | Andrino | A45F 5/00 | 224/148.5 |
| 6,550,271 | B2 * | 4/2003 | Silbert | A45C 11/20 | 62/371 |
| 6,866,159 | B2 * | 3/2005 | Yamane | A45F 5/00 | 150/901 |
| 6,976,370 | B2 * | 12/2005 | Fiene | F25D 3/08 | 62/371 |
| 8,757,427 | B2 * | 6/2014 | Hiner | B65D 25/20 | 220/739 |
| 8,844,763 | B1 * | 9/2014 | Momirov | B65D 33/28 | 220/739 |
| 9,193,516 | B2 * | 11/2015 | Hiner | B65D 81/3876 | |
| 9,420,908 | B1 * | 8/2016 | White | A47G 19/2288 | |
| 9,555,949 | B1 * | 1/2017 | French | B65D 81/3872 | |
| 2003/0230511 | A1 * | 12/2003 | Meza | A45C 7/0077 | 206/545 |
| 2006/0219858 | A1 * | 10/2006 | Iacovino | A47G 23/02 | 248/311.2 |
| 2015/0265083 | A1 * | 9/2015 | Myers | A45F 5/10 | 220/739 |

* cited by examiner

SOFT-SIDED BEVERAGE INSULATING DEVICE AND SYSTEM

CROSS-REFERENCE TO RELATED APPLICATIONS

This application has priority to Provisional Application No. 62/620,973 with a priority date of Jan. 23, 2018 and is a continuation of application Ser. No. 16/254,302, filed Jan. 22, 2019.

STATEMENT OF RESEARCH

Not applicable.

DESCRIPTION OF PRIOR ART

Beverage insulators have long been known and widely used. The most common type seen today are known as KOOZIE® insulated containers, which were first brought to market in 1982 in the form of a Styrofoam sleeve designed for cans or bottles.

The Prior Art has many shortcomings. This includes not enveloping the entire container with liquid content such as McGough U.S. Pat. No. 4,293,015 A. Or in the case of soft sided coolers such as Joss U.S. Pat. No. D465134 S1, they are not intended for simultaneous use of accessing the container with liquid content and providing the storage and insulating qualities.

Though the KOOZIE® insulated containers and variations thereof have achieved considerable popularity and commercial success, there has been a continuing need for improvement. The KOOZIE® insulated containers and other soft or hard sided items designed for containers with liquid content or beverage coolers do not provide a means to reseal a container with liquid content. Nor can they protect the container with liquid content from damage, breakage or spillage. Nor does it provide a means to attach or carry a container with liquid content. Once stored in a device such as a soft sided cooler, the container with liquid content is not designed to be used simultaneously. Soft sided coolers lack a frame to support the geometric shape or to provide a compartment for insertion of low voltage electronics that can be run on a battery. Further KOOZIE® insulated containers or soft-sided coolers lack the strike plating to prevent breakage or damage of the containers held within the device. Hand held KOOZIE® insulated containers lack an attachment system to secure a liquid beverage for transport. Further, these devices are not specifically designed to reduce vibrations transmitted to the liquid content held within the enveloped device.

Similarly, prior art lacks the combined ability to insulate a container with liquid content, seal said container with an integrated over-cap or cap, and open a factory sealed container with liquid content with an integrated device designed and integrated for such purpose. Sebastian's U.S. Pat. No. 7,685,908 B1 is an example of a device that includes an insulated embodiment with opener but is lacking the ability to reseal the container which it is designed to house and open.

SUMMARY OF THE INVENTION

Considered broadly, insulated beverage containers such as the KOOZIE® insulated containers comprise of an insulating material designed in such a way as to create a cylinder with a closed bottom and open top, in which the beverage can slide into. The insulating material of the sides and bottom of the container slow the rate at which the beverage increases or decreases in temperature due to the temperature of the ambient air or the users hand holding the beverage.

An example of said invention in use would be to keep a cold liquid cold while in an area of warmer ambient temperature, or a warm liquid warm when in an area of colder ambient temperature. The liquid would remain within its own container, and said container would be inserted into said body of said invention. Said walls of said body are composed of a plurality of layers. Said layers may or may not be thermoregulating, shock resistant, or moldable to aid in container protection and container resealing. Another embodiment of said device may include the ability to pair, match, connect or otherwise enjoin two devices as one unit for transport of more than one container with liquid content. For novelty purposes, the exterior of said device may or may not be altered to bear a novelty image for holidays, sports, recreation, animals or other novelty images without disturbing the underlying function of the device. These images can be applied via printed images onto said outermost layer of material or by appliqueing, embroidering, welding, or otherwise affixing cosmetic decoration. It is also possible to add electronic components and batteries for the addition of novelty LED or other lighting; sound; recording and playback features.

An embodiment may or may not include closures to include but not be limited to zippers, hook-and-loop material, snaps, magnets, etc. to allow for opening and closing of said embodiment.

An opener for a container with liquid content are unique to the invention and may or may not be affixed or integrated into the closure and are unique to the embodiment.

A cap or over-cap component of said invention would be welded, affixed, constrained, embedded, applied or contained within the body of the device; to be placed over the opening of the enveloped container with liquid content. For additional insulation as well as prevention of spillage and prevention of foreign objects entering into said container with liquid content. A pocket component may or may not exists on said body to house said cap or over-cap if not otherwise affixed in some manner when not in use.

An attachment may or may not exist on the body of said invention. For illustration, and not by way of limitation, an example of such is a loop of fabric stitched or otherwise affixed to said body of said invention to allow for a carabiner to be attached to said loop. A carabiner could then be attached to a backpack, allowing for said invention to act as a holder and carrier of said inserted container with liquid content.

The invention has a structure at the bottom to add form to said device and provide stability and balance to the enveloped container with liquid content. This structure can be modified to adapt to the type and size of container to be enveloped.

The foregoing and other objectives, features, and advantages of the invention will be more readily understood upon consideration of the following detailed description of the invention taken in conjunction with the accompanying drawings.

BRIEF DESCRIPTION OF THE SEVERAL DRAWINGS

In the drawings, which form a part of this specification,

DETAILED DESCRIPTION OF PREFERRED EMBODIMENTS

Figure 1A:
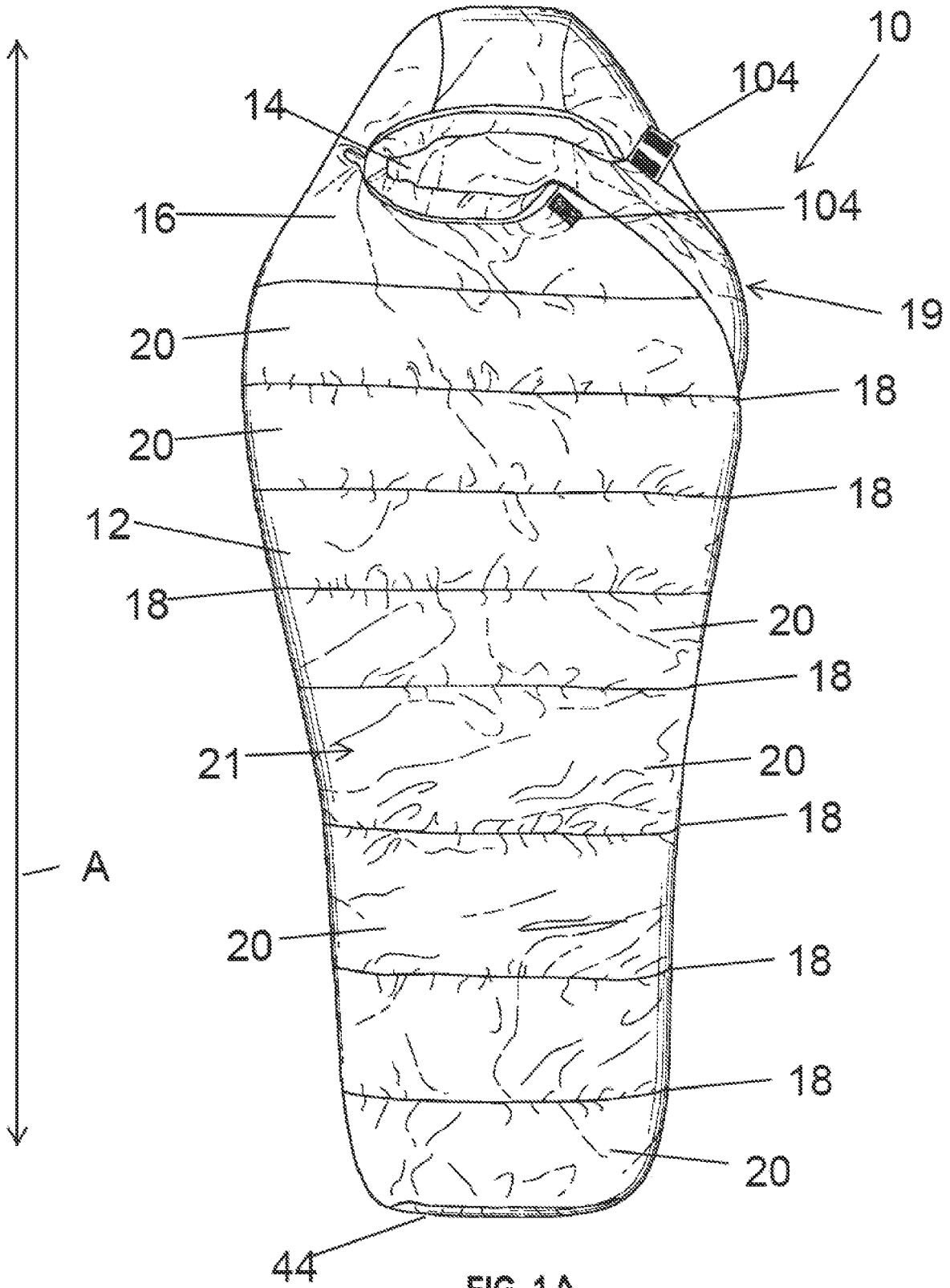
FIG. 1A is a front view of a body according to one embodiment of the invention.

An embodiment of the soft-sided beverage insulating device 10 according to the invention for illustration purposes and not by limitation, the embodiment of said invention is designed to enclose the majority of the container to be insulated, as seen in FIG. 1A, which in this particular embodiment is a glass bottle such as those used for beer, whiskey, wine or soda. Enclosing more of the surface of said bottle with said insulating material of which this embodiment is comprised, improves the efficiency of said invention's primary intent of reducing temperature change. Insulating device 10 is defined by a body 12, which in the illustrated embodiment is in the form of a conventional sleeping bag. Body 12 has an inner wall 14 and an outer wall 16 formed of resilient fabric and fastened together at plural fastening locations 18 that extend transverse to the vertical axis (arrow A, FIG. 1) of the body 12 to define plural compartments 20 that, as detailed below, may contain insulating material. Body 12 has an open top 100 and a closed base 44. The body 12 has a closure system defined by, for example, a zipper 102 (FIG. 6) that extends along the vertical axis at a vertical slit 19 in the body to the open top 100. The zipper 102 functions to selectively open and close the vertical slit 19 in body 12. Hook and loop closures 104 may also be utilized in addition to or in place of the zipper 102 for the same purpose.

Figure 1B:
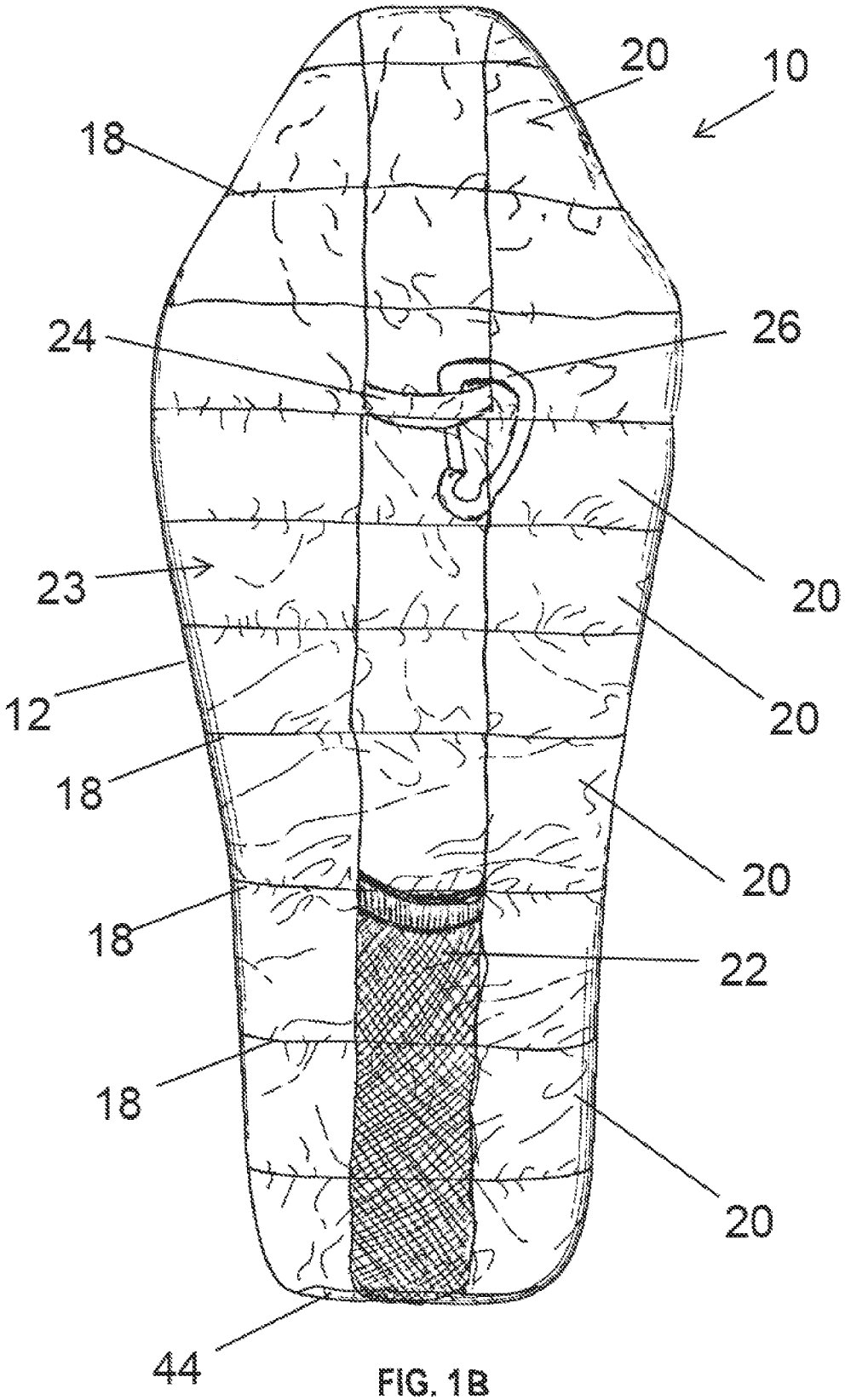
FIG. 1B is a back view of a body showing a storage pouch for storing a cap and a loop of material to be used for attaching said invention to an external embodiment (such as a backpack) for the purposes of carrying said invention.
Figure 1C:
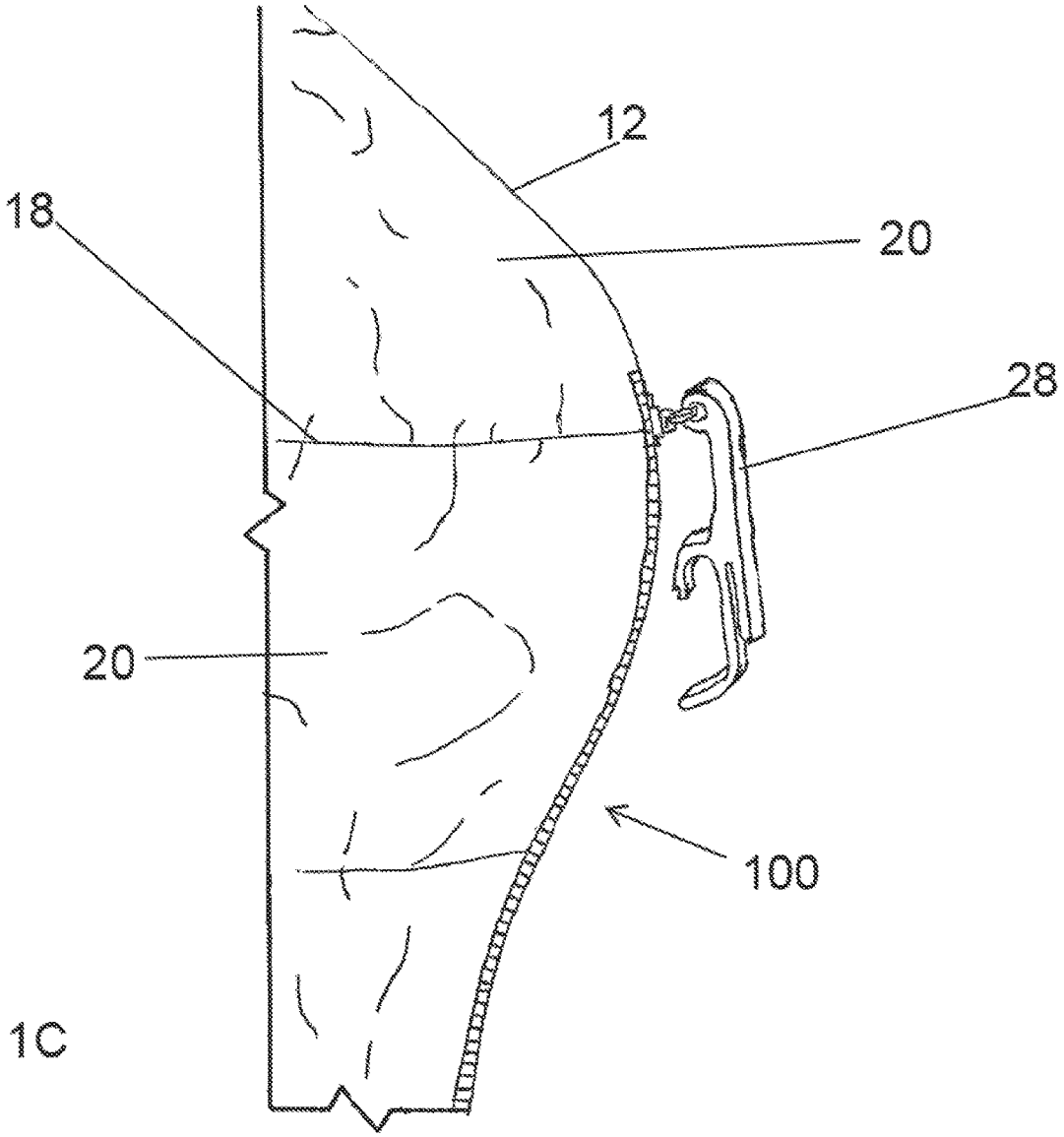
FIG. 1C is a view of a component which has the purpose of opening a sealed beverage container with an integrated leverage opening system for removeable cap style containers.

The back view of said body 12 is seen in FIG. 1B. An example of a storage pouch 22 is seen here for the purpose of storing or keeping an object of the user's desire or said cap or over-cap when not in use. Also seen in this view is a loop of fabric 24 to be used for the purpose of attaching said invention to another article as desired by a user with, for example, a carabiner 26 to be attached to said loop. FIG. 1C shows an example of one type of a container-opening device 28 such as the illustrated bottle opener, which has the purpose and ability to open the original manufacturer lid, cap, cork or seal of a container which may be held within said body of said invention. In the example image, said device is a customized bottle opener and is affixed to said body of said invention and has a second function to leverage the device itself open.

Figure 2:
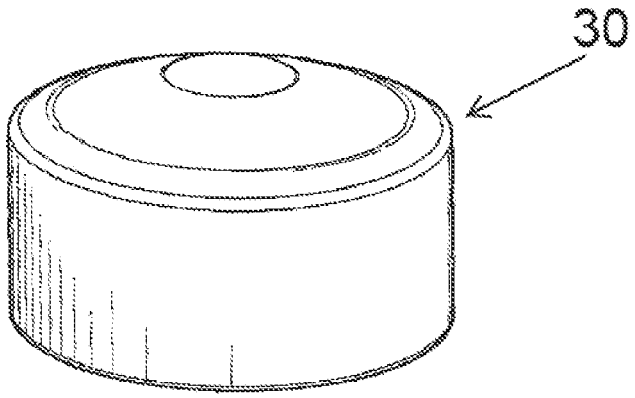
FIG. 2 is a view of a cap or over-cap.

FIG. 2 shows an example embodiment of a cap or over-cap 30 which can be used to seal the container being housed within the body shown in FIG. 1. The cap or over-cap 30 may be affixed to or held within a compartment on said body. Said cap or over-cap 30 provides additional insulating efficiency as well as the benefits of spillage prevention and preventing foreign objects from entering said container within said body.

Figure 3:
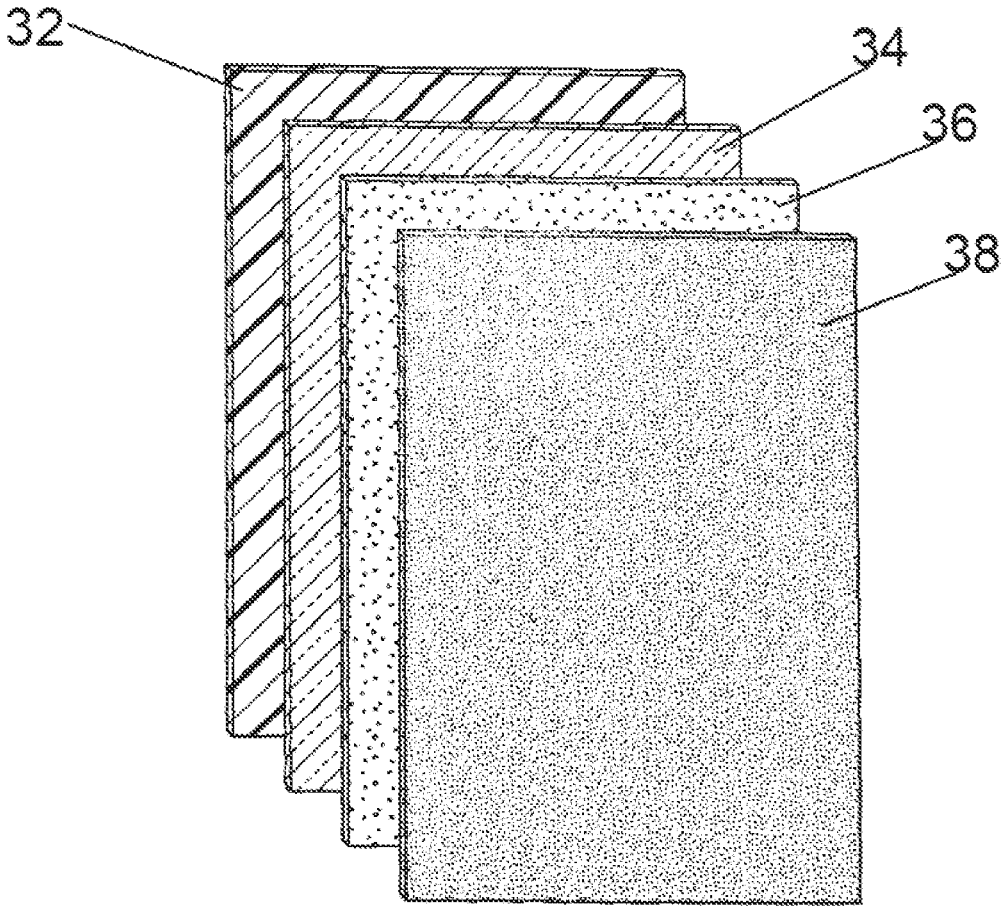
FIG. 3 is an exploded view of a plurality of layers of material comprised of an inner layer, an outer layer and a plurality of layers laminated between said inner and outer layers of various density and porosity.

FIG. 3 shows the plurality of layers, 32, 34, 36, and 38, which combine to form the material of which said body is comprised. By way of illustration said plurality of layers 32 through 38 could contain insulating materials a layer of gels, beads, foams, elastic, polyurethane foams or films, electrically conductive and electrically insulated materials, etc. Layers could provide such benefits as protection against impact, thermal insulation, active temperature modification, electrical communication between other integrated components, cosmetic novelty, etc. With a plurality of layers, a wicking layer can be added for an embodiment that is intended to stay cold, such as a beverage container. As the internal and ambient temperatures begin to match, the container sweating inside the device can have the sweat wicked to the surface. Thus, aiding in cooling the enveloped container and maintaining the liquid content at a cooler temperature for a longer period. In the illustration of FIG. 3, the inner wall 14 could be defined by layer 32 and the outer wall 16 could be defined by layer 38. The layers 32 through 38 may be thermoregulating, shock resistant, or moldable.

Figure 4:
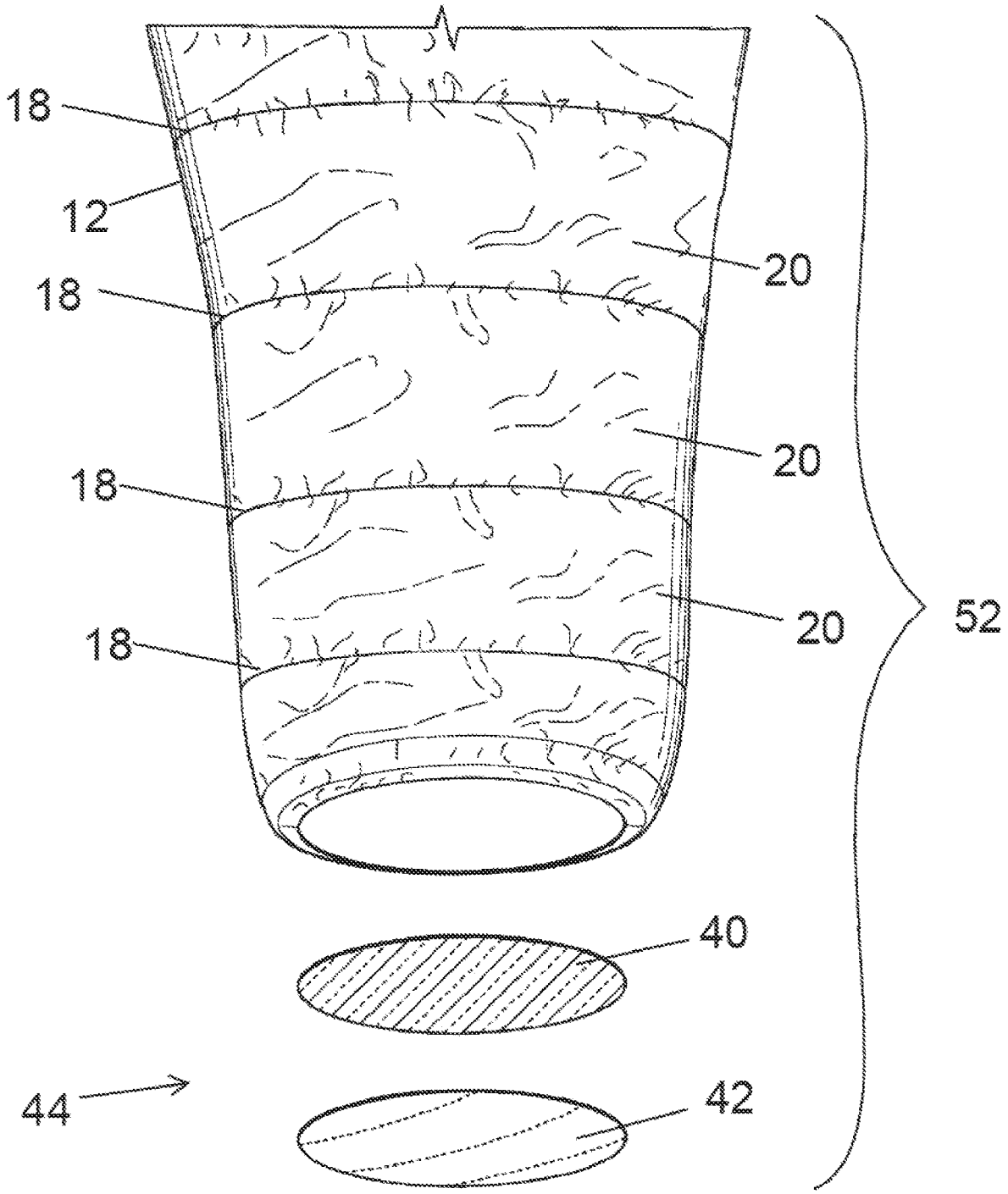
FIG. 4 is an exploded view of a plurality of layers comprising the base of an embodiment of said invention, including a material of relative stiffness to provide a more stable base for the beverage container to be housed within the embodiment, laminated between an inner and outer layer.

FIG. 4 shows a plurality of layers 40 and 42 that comprise the base 44 of said body 12. By way of illustration said plurality of layers 40 and 42 could contain a stiffened material to provide stability or form and may or may not use magnetic materials to provide magnetic adhesion to surface subject to magnetic adhesion. Or may use polyurethane or polysiloxane to provide structure, form, frame or strike/impact zones laminated between an inner and outer layer.

Figure 5:
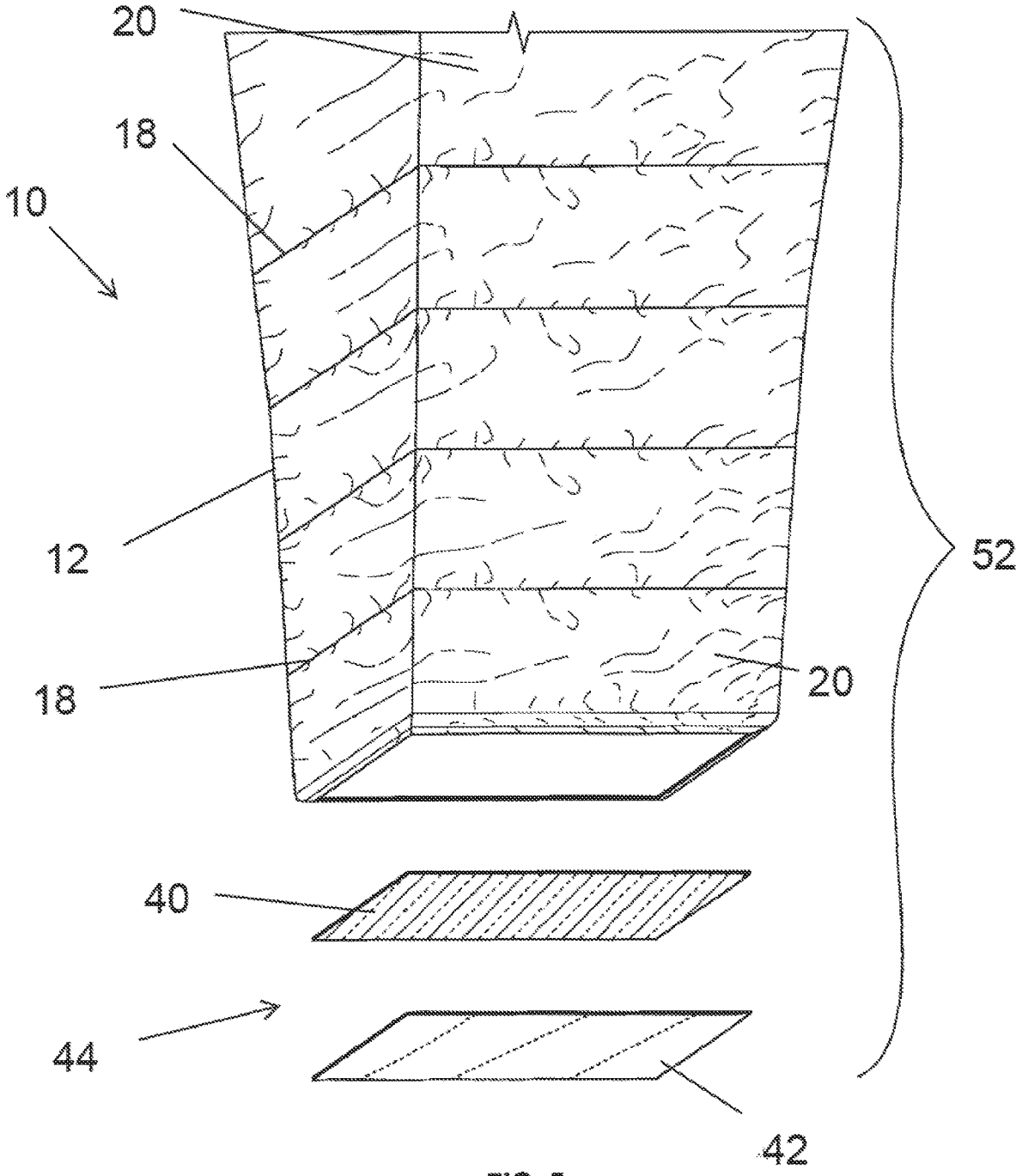
FIG. 5 is an exploded view similar to FIG. 4 included for the purpose of showing a different possible geometric shape of the base and embodiment of said invention.

FIG. 5 shows again the base 44 of said body 12 with a plurality of layers 40 and 42. The purpose of FIG. 5 is to show the geometric shape of said body 12 can be designed in a plurality of shapes or sizes best befitting the intended container to be contained within said body.

Figure 6:
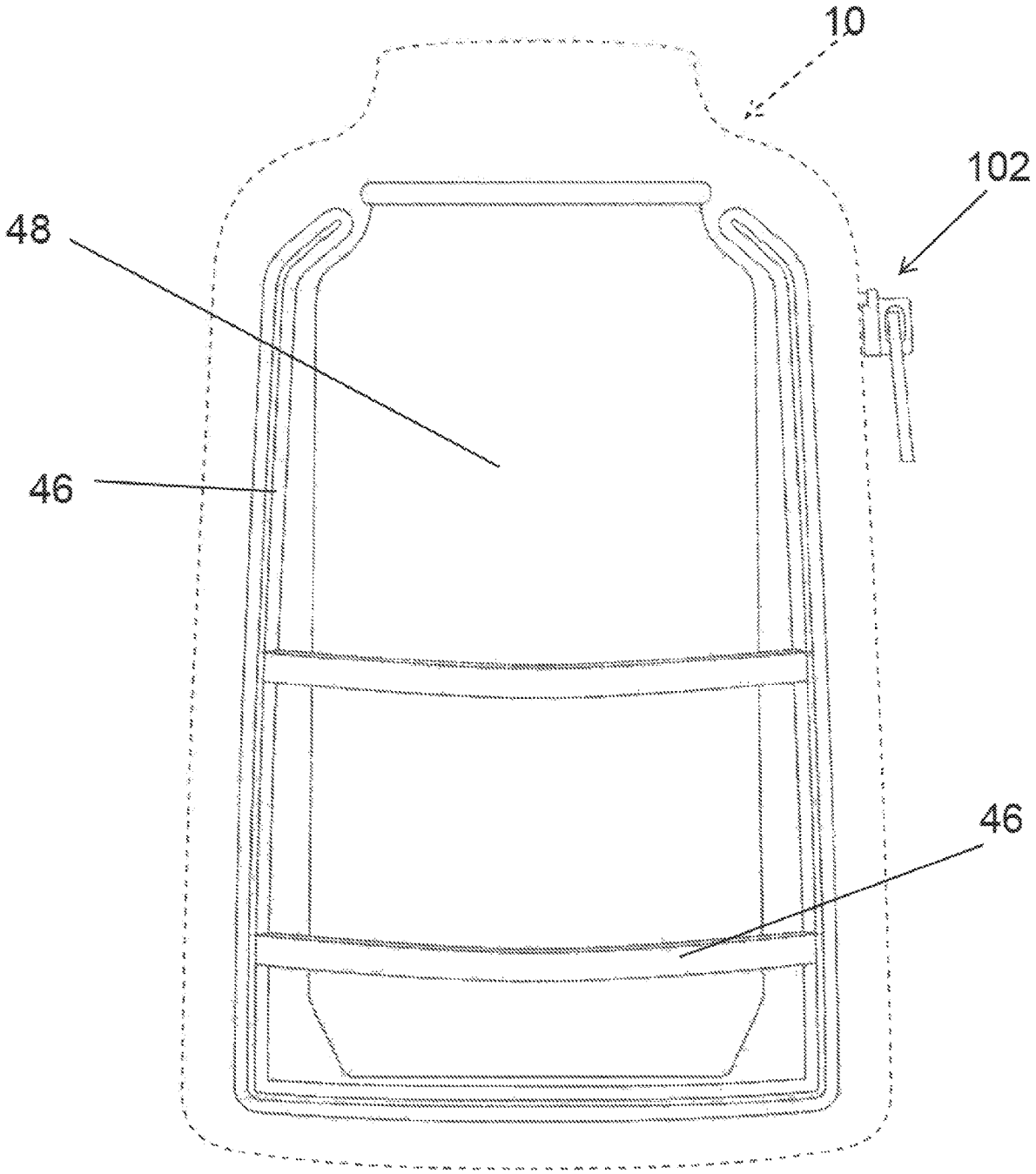
FIG. 6 is an example of an internal frame to support the geometric structure and provide stability or protection for the enveloped or encased liquid beverage container.

FIG. 6 is an example of an internal frame 46 to support the geometric structure of body 12 and provide stability or protection for the enveloped or encased liquid beverage container 48, which as illustrated is a conventional can. This geometric shape of this internal frame 46 can be altered to protect and support the invention as well as the liquid beverage container 48 encased within the device. The density of the material used for the internal frame 46 can be altered to match the type of liquid beverage container to be encased. For example, a soda can 48 would take a stiffer frame than a glass wine bottle due to the difference in the ability to puncture the liquid beverage container. A polysiloxane internal frame 46 may be suitable for vibration and impact resistance if dropped for a wine bottle, but a soda can 48 may need a polyurethane frame with a strike plate to prevent puncture.

Figure 7:
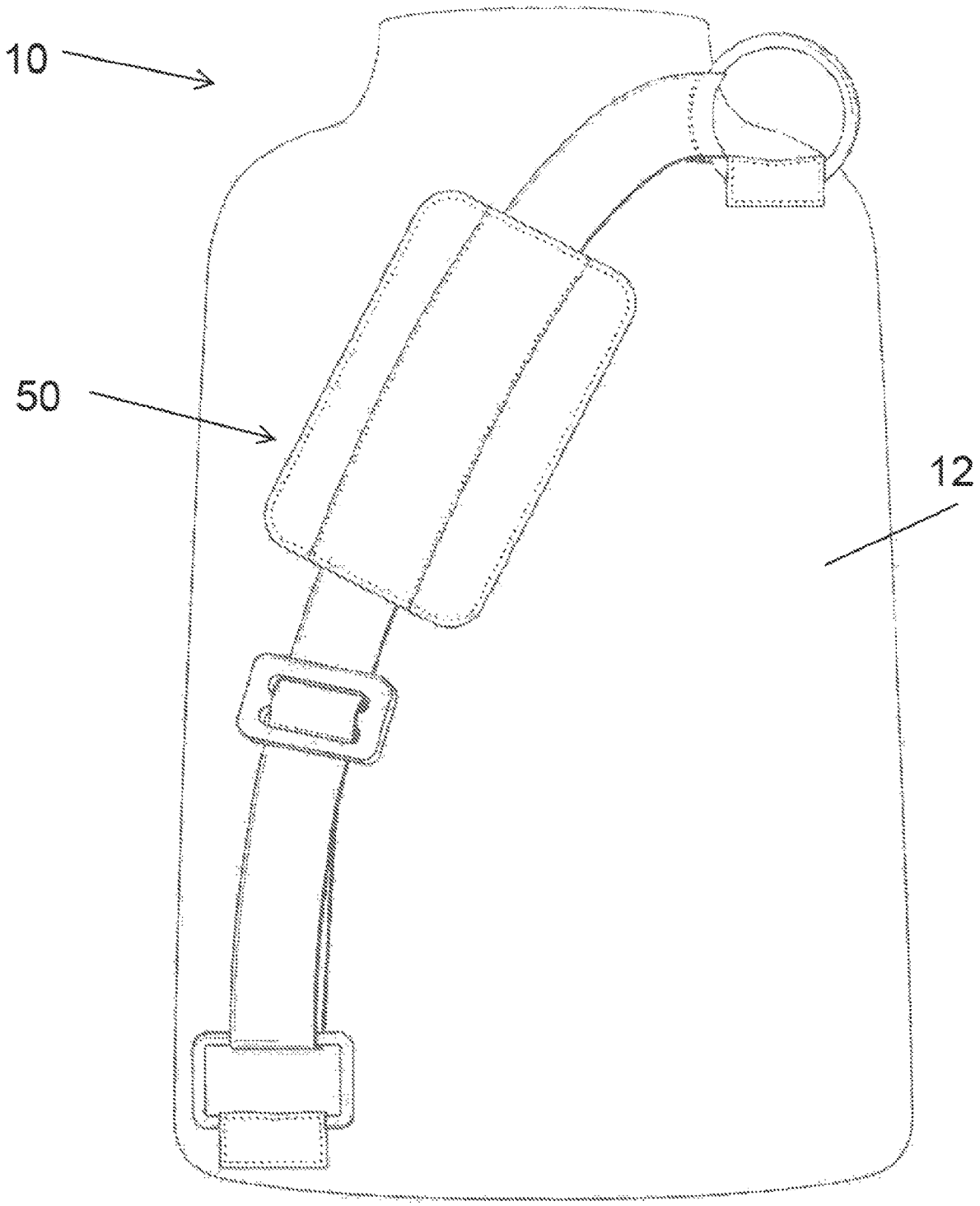
FIG. 7 is an example of a carrying or transportation strap that is adjustable to the end-user fitting needs.

FIG. 7 is an example of a carrying or transportation strap 50 that is adjustable to the end-user fitting needs. For illustration purposes only; a bike rider may wish to sling the device over a shoulder. Whereas a hiker, may wish double straps to carry like a day pack; or a molly mount to attach as an external hydration carrier.

Figure 8:
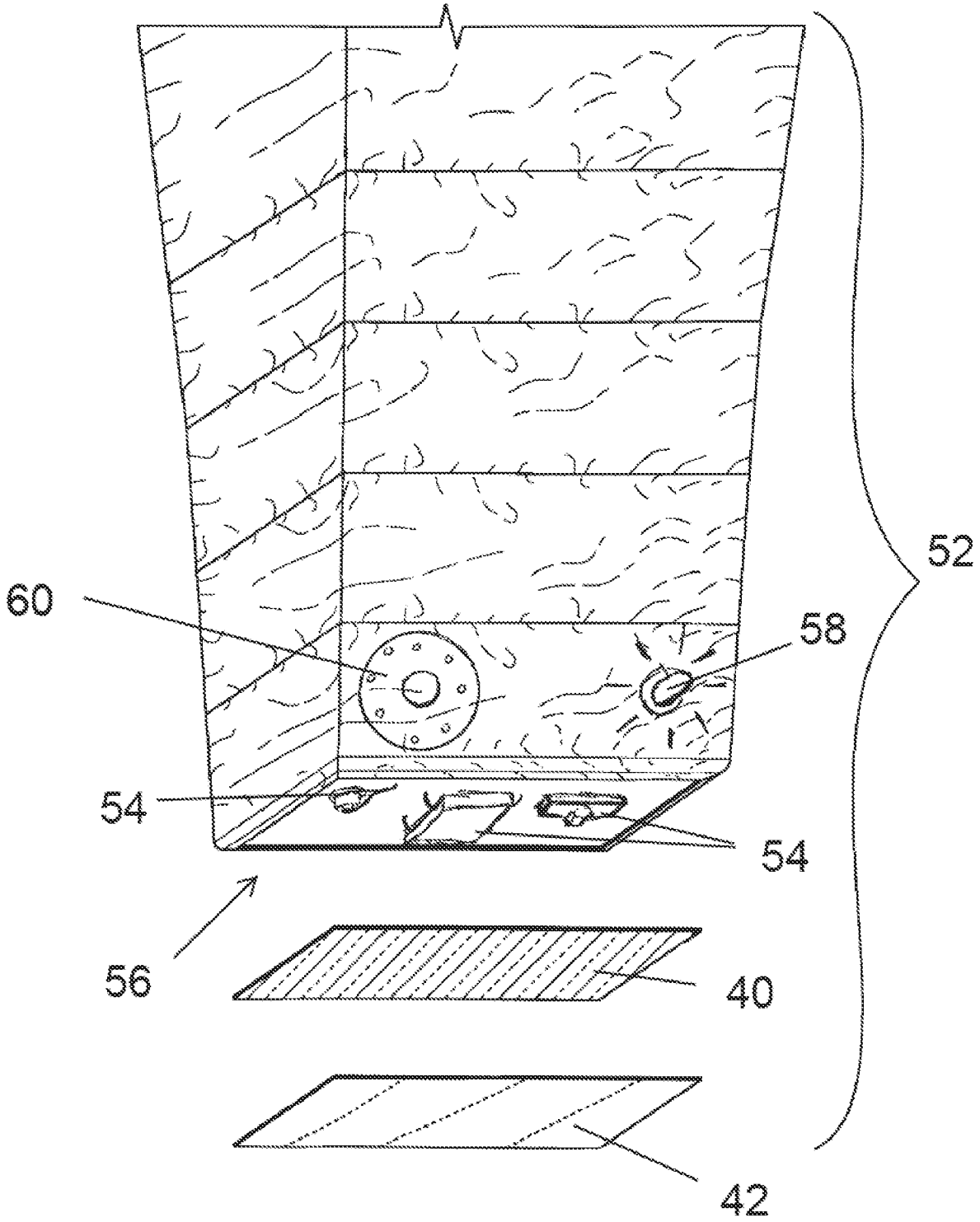
FIG. 8 is a view of the lower section of said body illustrating the use of electronic components such as power, sensors, emitter, recorder, receiver, processor, to add light, sound, buzzer to said body.

FIG. 8 is a view of the lower section 52 of said body 12 illustrating the use of electronic components 54 such as a battery compartment 56 for power, sensors, emitter, recorder, receiver, processor, to add light 58, sound, buzzer 60 or other novelty to said body 12. The light 58 could be for purely novel purposes, to aid in the identification of a bike rider, hiker or pedestrian in low lighting conditions, and may or may not have warning light flashing capability.

Figure 9:
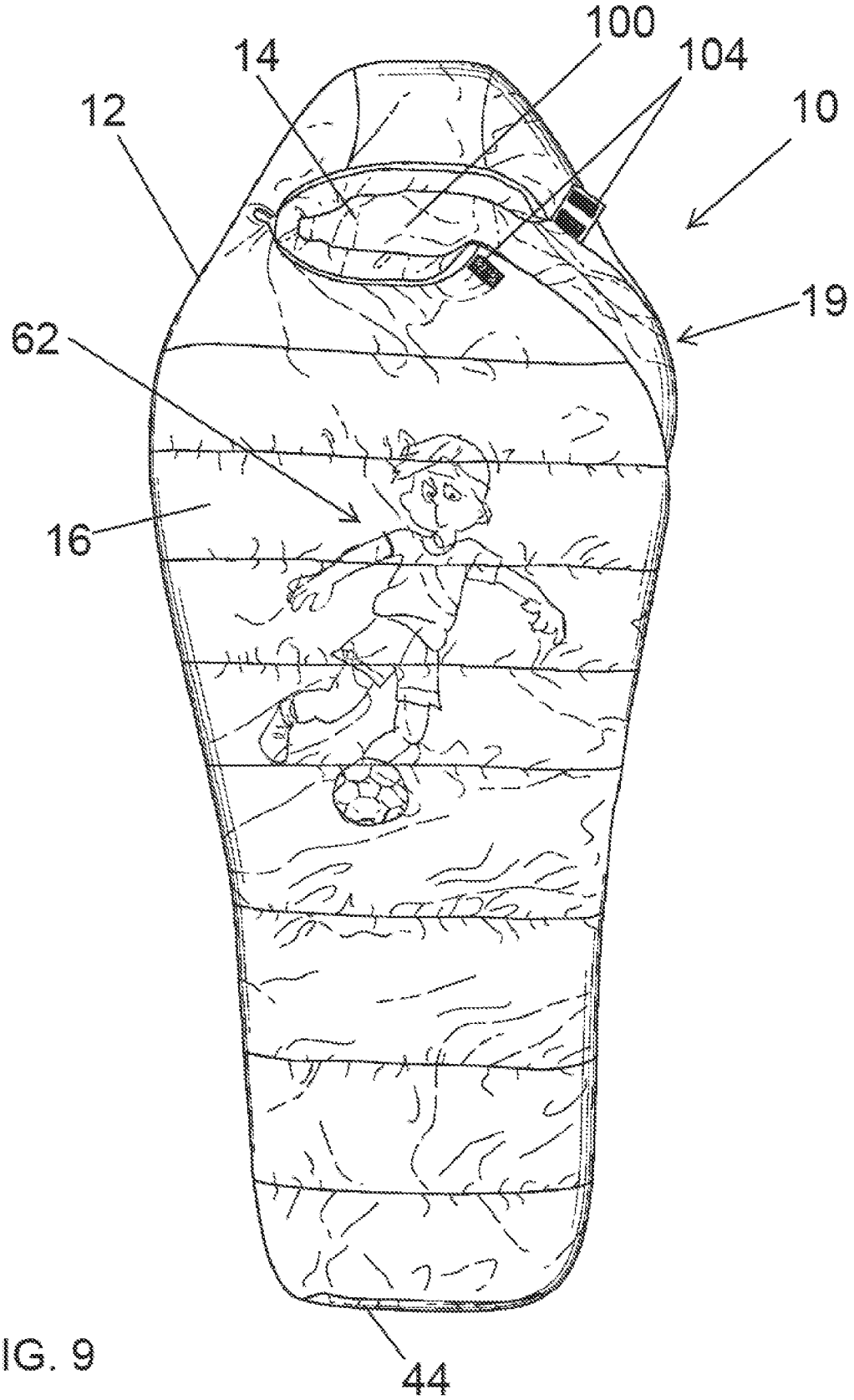
FIG. 9 is a view of said body including an image as a novelty example of a cosmetic change to the exterior.

FIG. 9 is a view of said body 12 including an image 62 as a novelty example of a cosmetic change to the exterior. It is envisioned that the exterior of the device can be cosmetically altered without disrupting the utility of the device. Thus, allowing the device to be customized for commercialization purposes. For example, the device can be themed for holidays visually with a midi sound file that plays a holiday theme. Another illustration would be to custom the device with licensed indicia for sports or organizations. Or to allow children decorate their own device with a markable outer surface.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

The invention claimed is:

1. A beverage container insulator, comprising:

a soft-sided generally cylindrical body having a vertical axis, a top, and a closed bottom, and a main body portion having a front and a back, the main body portion being defined by an inner wall and an outer wall extending from the top to the closed bottom to define an interior beverage container compartment for receiving a beverage container therein, the body fastened together at plural fastening locations extending transverse to the vertical axis to define plural compartments extending transverse to the vertical axis and containing insulating material, wherein the closed bottom includes a stiffened material;

wherein the top of the generally cylindrical body includes an arcuate closed portion opposite the closed bottom along the vertical axis, and an open area in the front of the main body portion immediately below the arcuate closed portion; and wherein the main body portion includes a vertically extending slit through the inner and outer walls, the slit defining an opening into the interior beverage compartment, the slit extending up a side of the main body portion, between the front and back, and a closure element for selectively opening the vertically extending slit to admit a beverage container into the interior beverage container compartment, and closing the vertically extending slit to retain a beverage container in the interior beverage container compartment.

2. The beverage container insulator according to claim 1 in which the closure element is a zipper.

3. The beverage container insulator according to claim 2 wherein the closure element further comprises a hook and loop closure positioned between an upper end of the zipper and the open area.

4. The beverage container insulator according to claim 1 in which the closure element is a hook and loop fastener.

5. The beverage container insulator according to claim 1 in which the stiffened material comprises a polyurethane or polysiloxane.

6. The beverage container insulator according to claim 1 including an internal frame enveloping the interior beverage compartment to provide stability for a beverage container retained within the soft-sided body.

7. The beverage container according to claim 1 wherein the body is substantially in the form of a sleeping bag.

8. The beverage container insulator according to claim 1 wherein the main body portion includes a narrow region adjacent the arcuate closed portion, a wider region directly below the open area, and a tapered region, narrower than the wider region, adjacent the closed bottom.

* * * * *